United States Patent [19]

Anderson

[11] Patent Number: 4,537,220

[45] Date of Patent: Aug. 27, 1985

[54] TWO MEMBER BOOST STAGE VALVE FOR A HYDRAULIC CONTROL

[75] Inventor: Wayne R. Anderson, Bloomington, Minn.

[73] Assignee: Sundstrand Corporation, Rockford, Ill.

[21] Appl. No.: 470,891

[22] Filed: Feb. 28, 1983

[51] Int. Cl.[3] ..... E03B 3/00

[52] U.S. Cl. ..... 137/625.64; 91/433; 137/596.14

[58] Field of Search ..... 137/596.14, 596.15, 137/596.18, 625.64; 91/433

[56] References Cited

U.S. PATENT DOCUMENTS

| | | | |
|---|---|---|---|
| 2,880,708 | 4/1959 | Hayner . | |
| 3,064,627 | 11/1962 | Blanton | 91/433 |
| 3,405,727 | 10/1968 | Hill | 137/625.64 |
| 3,411,536 | 11/1968 | Tennis | 137/596.15 |
| 3,580,281 | 5/1971 | Petersen | 137/625.64 |
| 3,771,424 | 11/1973 | Allen et al. | 91/433 |
| 3,841,345 | 10/1974 | Cryder | 137/596.15 |
| 3,854,382 | 12/1974 | Walters et al. | 91/433 |
| 4,145,957 | 3/1979 | McClockin | 137/596.14 |
| 4,362,182 | 12/1982 | Sjolund | 137/625.64 |
| 4,368,750 | 1/1983 | Burton | 91/433 |

FOREIGN PATENT DOCUMENTS

| | | |
|---|---|---|
| 218711 | 5/1958 | Australia . |
| 432799 | 12/1970 | Australia . |
| 807917 | 1/1959 | United Kingdom . |
| 856144 | 12/1960 | United Kingdom . |
| 2076182 | 9/1963 | United Kingdom . |
| 957725 | 5/1964 | United Kingdom . |
| 1011523 | 12/1965 | United Kingdom . |
| 1353044 | 5/1974 | United Kingdom : |
| 1500796 | 2/1978 | United Kingdom . |

OTHER PUBLICATIONS

"Ingenieur Digest" pp. 112 and 113, Apr., 1970, with translation.

*Primary Examiner*—Edward G. Favors
*Assistant Examiner*—Steven E. Warner
*Attorney, Agent, or Firm*—James A. Wanner; Ted E. Killingsworth; Harold A. Williamson

[57] ABSTRACT

The present invention is directed to a two stage hydraulic servo amplifier wherein the boost stage valve comprises two separate valve members, each individually controlling one of a pair of controlled outputs and wherein the position of each valve member is modulated by inputs from a pilot stage acting against separate biasing forces for each valve member.

11 Claims, 9 Drawing Figures

TWO MEMBER BOOST STAGE VALVE FOR A HYDRAULIC CONTROL

FIELD OF THE INVENTION

The field of the invention relates to a boost stage valve which is used in a two stage hydraulic control wherein a first pilot stage provides a pressure differential which acts upon the improved boost stage which has a pair of controlled outputs which may be connected across a load such as a hydraulic ram or a further valve stage.

BRIEF DESCRIPTION OF THE PRIOR ART

Two stage hydraulic controls are well known wherein a first pilot stage provides flow or pressure control signals which are in turn utilized to operate a boost stage which regulates or controls fluid flow in larger quantities than the pilot valve is capable of handling or controls fluid pressure at pressure levels higher than the design capabilities of the pilot stage valve. The control flow or pressure output of the boost stage valve is then utilized to operate a load such as a third stage control or other hydraulic device. In many of these two stage controls, the input to the boost stage has been a flow differential while the output of the boost stage has been either a flow differential or a pressure differential. Many of the prior art devices require some form of mechanical feedback between either the boost stage and the pilot stage or the load and the pilot stage.

One form of the prior art utilizes a pressure control pilot stage such as taught in U.S. Pat. No. 4,362,182 issued to John R. Sjolund on Dec. 7, 1982 and entitled "Nozzle Force Feedback for Pilot Stage Flapper". The output of this pressure control pilot valve is a pressure differential between two control ports, wherein the pressure differential is generated by the position of a flapper between two nozzles regulating the back pressure generated by the flow through the nozzles from a supply source. This pilot stage valve, with its pressure differential output, has been utilized to control a four way boost stage valve having a single valve spool which modulates the communication of two controlled outputs with a high pressure source of fluid flow and with a low pressure tank or flow return. In a flow control version of such two stage valve, the single valve spool is positioned by a balancing of forces generated by a pair of pilot valve signals and by opposing springs. In a pressure control version of the two stage valve, the single valve spool is positioned by a balancing of forces generated by a pair of pilot valve signals and by a pair of feedback signals from the two controlled outputs. Thus the single valve spool, and thus all the critical flow controlling edges thereon which are rigidly positioned relative to each other, are all controlled by the total combination of the forces applied to the boost stage valve.

The single valve spool of a four way valve must provide at least four critical flow controlling edges. For each of the two controlled outputs the valve spool must provide two critical edges, one controlling communication to the high pressure supply and one controlling communication with a flow return port. Since these four critical flow controlling edges are all on a single valve spool, all four edges must move in unison and thus there can be no separate adjustment of the critical edges for one output relative to the critical edges for the other output. Therefore any null adjustment of the valve for a first boost stage output automatically causes the same null adjustment (or what may be a misadjustment) for the second boost stage output. Furthermore, for each output, the critical edges controlling the high pressure supply and the flow return connection must be machined relative to each other, and such machining is subject to extremely critical tolerances. However since both outputs utilize the same valve spool, all four critical edges must be machined relative to each other under very tight tolerances.

SUMMARY OF THE INVENTION

The present invention is directed to utilizing a pair of movable valve members in a boost stage valve of a servo amplifier wherein each valve member separately controls one of a pair of controlled outputs and wherein each valve member is subjected to at least one control pressure from the pilot stage valve.

By using two separate easily machined valve members, an inexpensive, easily machined, amplifier or boost stage valve is obtained which performs well when compared to previous four way boost valves. Such a boost stage valve may also have two short bores and be relatively compact.

It is thus an object of the present invention to use a separate valve member to control each of a pair of boost stage outputs and wherein each valve member has only one critical dimension, that dimension separating two flow controlling edges with one edge controlling the connection to a high pressure source and the other edge controlling the connection to a flow return, and wherein the machining of such one dimension is not critical relative to machining of the other valve member's critical edges.

It is a further object of the invention to use two separate valve members in a boost stage valve wherein each valve member, controlling a separate output, can be individually adjusted relative to its output without affecting the adjustment of the second valve member relative to its output.

It is yet another object of the invention to utilize separate valve members to individually control a pair of outputs for a boost stage valve wherein each valve member is individually controlled only by those forces necessary to provide its control function and not subject it to those forces solely necessary for controlling the other valve member.

Yet another object of the present invention is to utilize a pair of individual valve members to control a pair of outputs for a boost stage valve wherein each valve member has less mass than a single valve member operating both of the pair of outputs, and thus each of the two valve members can react quicker to forces applied thereon to reduce the time of response of the system.

It is yet another object of the present invention to provide a two stage pressure control valve wherein the boost stage provides a differential pressure between two outputs, each controlled by a separate valve member and wherein pressure feedback from each output only acts upon the valve member controlling such output. Furthermore, by having the feedback applied to a reduced cross section area of the valve member, the controlled output pressure may be amplified relative to an input control signal. By having separate valve members controlling each boost stage output, feedback amplification may also be varied between the two outputs.

Furthermore, an object of the present invention is to provide a boost stage valve for a two stage hydraulic control having a pilot stage transducer which converts an input signal into a first signal $C_1$ and a second signal $C_2$, a source of fluid flow under pressure $P_S$ and a flow return $P_T$ at pressure lower than $P_S$, the boost stage valve comprising first and second valve members movable within first and second valve chambers respectively, a first boost stage controlled output in fluid communication with the first valve chamber, a second boost stage controlled output in fluid communication with the second valve chamber, said first and second boost stage outputs being applied across a load, means for applying the first pressure signal $C_1$ to at least one of the valve members so as to move the one valve member against a first biasing force, means for applying the second pressure signal $C_2$ to at least the other of the valve members so as to move the other valve member against a second biasing force, the source of flow $P_S$ and the flow return $P_T$ communicating with both of the valve chambers whereby movement of the first and second valve members controls fluid communication between the first and second boost stage outputs respectively from the source of flow $P_S$ and to the flow return $P_T$.

DESCRIPTION OF THE PREFERRED EMBODIMENTS

The boost stage valve of the present invention which utilizes a pair of valve members can be used in both a two stage flow control and a two stage pressure control. The two stage flow control is taught in FIGS. 1–4 while the two stage pressure control is taught in FIGS. 5–9.

Figure 1:
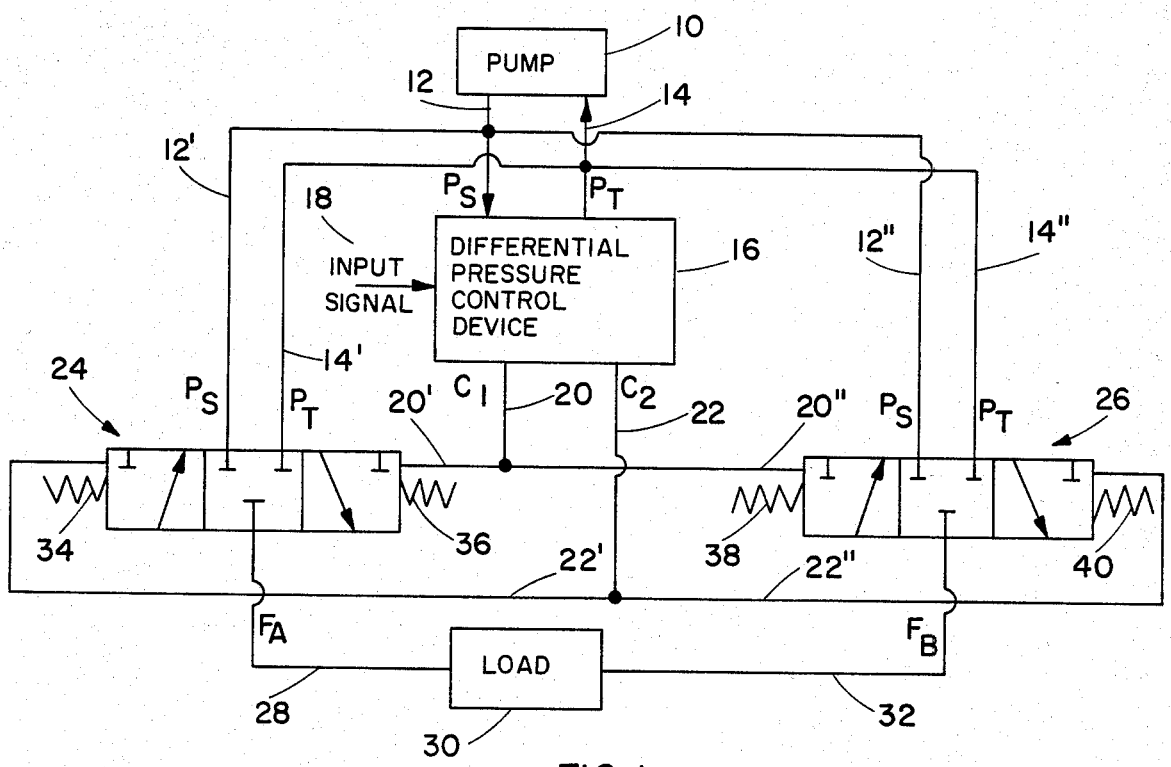
FIG. 1 is a schematic diagram of the two member boost stage valve of the present invention as used as a flow control.

As seen in the schematic of FIG. 1, the two stage flow control valve system is provided with fluid under pressure such as by a pump 10 and line 12. This high pressure source is referred to herein as $P_S$. Also provided is a flow return line 14 which is at lower pressure than $P_S$ and may lead to either a tank or sump (or other low pressure area) either directly or through the pump 10. This flow return is referred to herein as $P_T$.

The high pressure flow source $P_S$ and the flow return $P_T$ are connected to a differential pressure control device 16 which utilizes an input signal 18 to generate two pressure output signals $C_1$ and $C_2$ in lines 20 and 22 respectively. The structure and operation of one form of such control device 16 are taught in U.S. Pat. No. 4,362,182 issued to John R. Sjolund on Dec. 7, 1982. It is important to note that this pilot stage control device 16 acts as a pressure control rather than a flow control. This pressure control pilot stage valve is referred to herein as a PCP.

The high pressure source $P_S$ is also connected by lines 12' and 12'' to a first boost stage valve 24 and a second boost stage valve 26. In a similar manner, the flow return $P_T$ is also connected to the first and second boost stage valves 24 and 26 by lines 14' and 14''. The first boost stage valve 24 has a flow control output $F_A$ connected to load 30. The second boost stage valve 26 has a flow control output $F_B$ also connected to load 30 by line 32. The first boost stage valve 24 is biased to a centered or null position by springs 34 and 36 while the second boost stage valve 26 is also biased to a centered or null position by springs 38 and 40. The first pressure signal $C_1$ of the PCP 16 is applied to both boost stage valves by lines 20, 20' and 20'' while the second pressure signal $C_2$ is connected to the opposite ends of the two valves respectively by lines 22, 22' and 22''.

It can thus be seen that when an input signal 18 causes the PCP 16 to generate a high pressure signal $C_1$ and a low pressure signal $C_2$, that the pressures applied will cause boost stage valve 24 to move toward the left while boost stage valve 26 will move toward the right. Leftward movement of the first valve 24 connects the high pressure source $P_S$ of line 12' with the valve output $F_A$ of line 28. Rightward movement of the second valve 26 connects the flow return $P_T$ of line 14'' with the second valve output $F_B$ of line 32. Thus differential flow is provided to the load 30 with the flow $F_A$ in line 28 being toward the load and the flow $F_B$ of line 32 being away from the load 30. Such a control utilizes the boost stage valves 24 and 26 to provide a flow capacity larger than the capacity of the PCP 16. A reversal of pressure differential by the PCP 16 would cause signal $C_2$ to be of higher pressure than signal $C_1$ and thus provide reverse operation from that described above. When the two signals $C_1$ and $C_2$ are at equal pressure, the two boost stage valves 24 and 26 are centered to their null position by the springs so that there is no differential flow to load 30.

Figure 2:
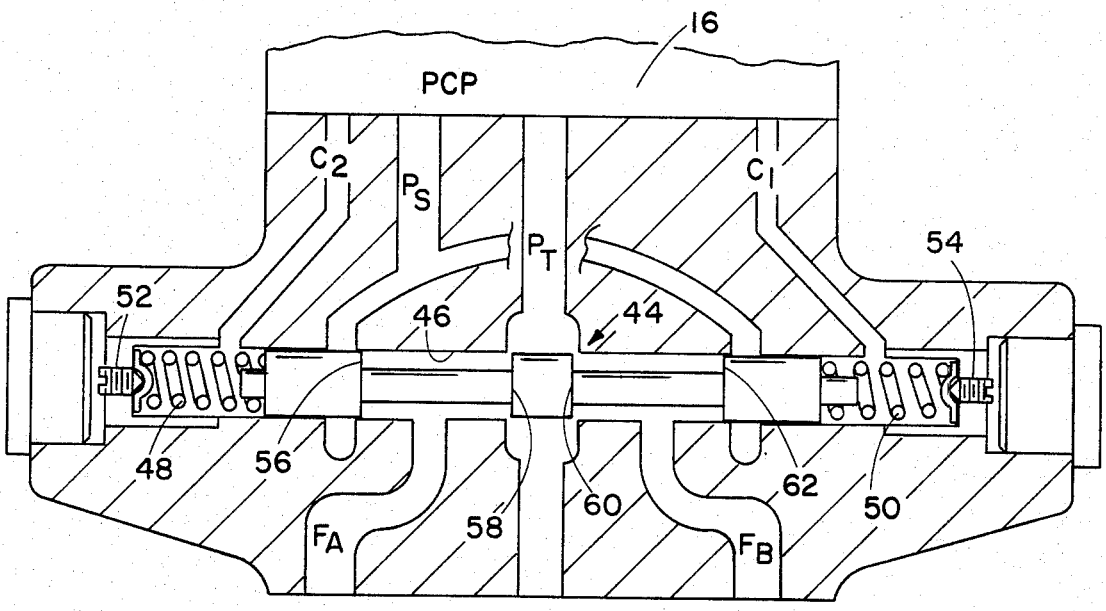
PRIOR ART FIG. 2
FIG. 2 is a cross sectional view of a prior art single spool boost stage valve used as a flow control.

FIG. 2 teaches a prior art device utilizing a single valve spool 44 axially movable in a bore 46 which acts as a four way valve to control the output $F_A$ and $F_B$ by controlling the fluid communication with the pressure source $P_S$ and flow return $P_T$. The spool 44 is biased to a centered or null position by springs 48 and 50 each of which are provided with an adjustment device 52 and 54. The control signals $C_1$ and $C_2$ of the PCP 16 are applied to the bore 46 outboard of the ends of the spool 44. The control signals $C_1$ and $C_2$ provide a pressure differential which modulates the position of the spool 44 within bore 46. The spool 44 has three lands which provide control edges 56, 58, 60 and 62. Control edges 56 and 62 control the communication of outputs $F_A$ and $F_B$ respectively with the source $P_S$. The edges 58 and 60 of the center land respectively control the fluid communication of outputs $F_A$ and $F_B$ with the flow return $P_T$. As is well known in the hydraulic valve art, the relative positioning of the control edges is provided by machining and is quite critical in order to provide the proper flow characteristics. Since all four control edges of the prior art valve are machined on a single spool, they are fixed relative to each other and furthermore require critical machining operations to assure proper positioning of any control edge relative to the other three.

Figure 3:
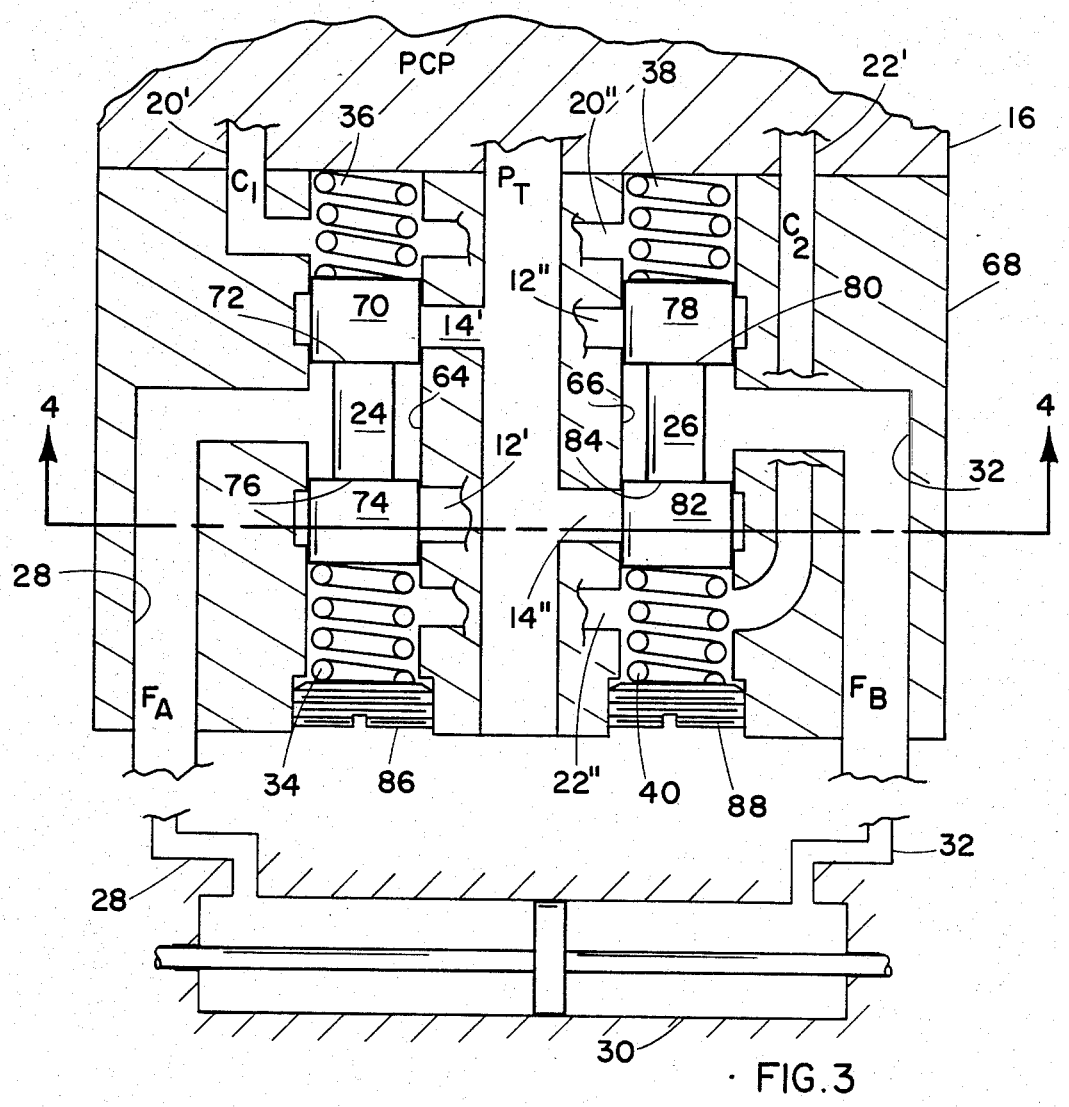
FIG. 3 is a cross sectional view of the two member boost stage valve of the present invention as used for a flow control.
Figure 4:
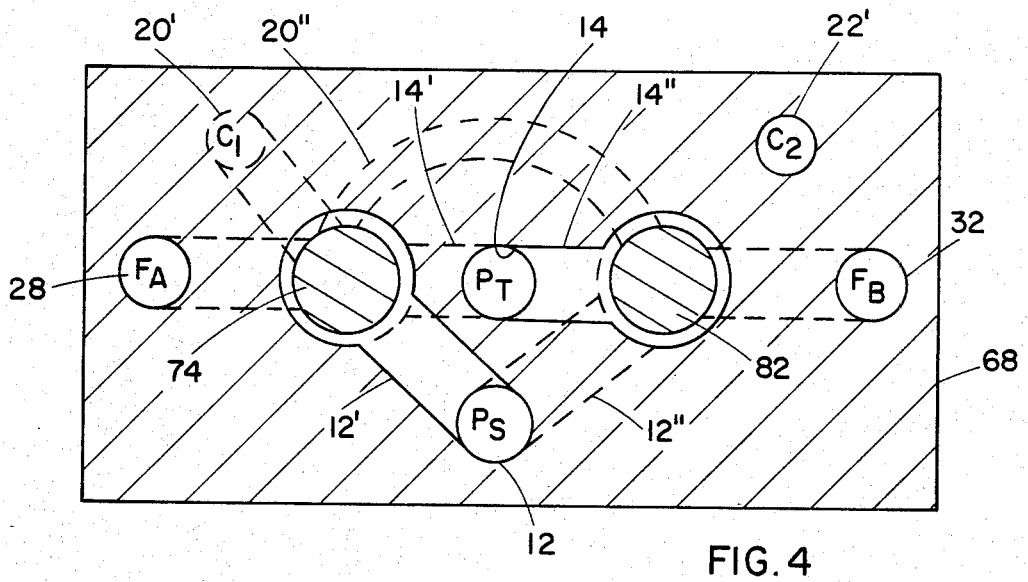
FIG. 4 is a sectional view taken along lines 4—4 of FIG. 3 of the two member boost stage.

FIGS. 3 and 4 show sectional views of the improved flow control boost stage valve wherein the two boost stage valve members 24 and 26 are utilized instead of a single spool valve. In the preferred form, valve members 24 and 26 are in the form of a valve spools which are axially movable within short parallel bores 64 and 66 extending from end to end of a compact boost stage valve housing 68 mounted directly beneath the PCP 16. The first valve member 24 has a first land 70 with a flow controlling edge 72 and a second land 74 with a flow controlling edge 76. The second valve member 26 has a first land 78 with a flow controlling edge 80 and a second land 82 with a flow controlling edge 84. Centrally connected to the valve bores 64 and 66, between the lands of the valve spools 24 and 26, are the flow control output lines 28 and 32 respectively. This compact valve housing 68 with the two parallel bores only requires machining from the two ends thereof, rather than machining from four faces as required by the prior art single spool valve of FIG. 2.

The valve spools 24 and 26 are axially positioned within the bores 64 and 66 by the springs 34, 36, 38 and 40 mentioned with respect to the schematic of FIG. 1. The two lower springs 34 and 40 may be adjusted by plugs 86 and 88 which are threadably mounted at the end of the bores 64 and 66 and are furthermore provided with slots to receive a screwdriver. The first control signal $C_1$ of the PCP 16 is applied to the upper ends of both valve bores 64 and 66 to provide a downward bias on the valve spools 24 and 26. In the preferred form, line 20' is connected to the upper end of bore 64 while line 20'' connects the upper end of bore 64 with the upper end of bore 66. In a similar manner, PCP signal $C_2$ is connected with the lower end of both bores 64 and 66 by lines 22' and 22''. Line 22'' is not seen in FIG. 4 since it is below the cross section 4—4.

Centrally located within the valve body 68 is the flow return $P_T$ which is connected to bore 64 adjacent the land 70 by line 14' and connected to bore 66 adjacent land 82 by line 14''. Hidden behind the flow return $P_T$ in FIG. 3 is the line for source $P_S$ which is connected to the bore 64 adjacent land 74 by line 12' and connected to the bore 66 adjacent land 78 by line 12'', all in accordance with the schematic of FIG. 1. Thus, it can be seen that control edges 72 and 84 control the communication of outputs of $F_A$ and $F_B$ respectively with flow return $P_T$ while control edges 76 and 80 control the fluid communication of outputs $F_A$ and $F_B$ respectively with the source $P_S$. As can be seen in FIG. 3, the valve spool lands are provided with full periphery flow controlling edges which cooperate with full periphery porting from $P_S$ and $P_T$. For stable valve operation, this requires the use of stiff valve centering springs. If less stiff springs are used, the flow controlling edges (or inlets) may be tapered or knotched to provide gradual opening, but this also requires longer valve stroke to fully open and close the porting.

An increase in signal $C_1$ by PCP 16, and thus a decrease in signal $C_2$, causes valve spools 24 and 26 to move downwardly (as seen in FIG. 3) against the bias of springs 34 and 40. This causes boost stage output $F_A$ to be connected to source $P_S$ while output $F_B$ is connected to flow return $P_T$. A reversal in pressure between $C_1$ and $C_2$ will have the opposite effect of raising both valve spools against the bias of springs 36 and 38 and reversing the fluid connection of outputs $F_A$ and $F_B$ relative to the pressure source $P_S$ and flow return $P_T$. The resistance of the springs against valve spool movement causes the respective control pressures $C_1$ and $C_2$ to increase to generate further valve spool movement. This provides a pressure feedback to the PCP 16.

It can be seen that each valve spool has only two flow controlling edges, edges 72 and 76 for valve spool 24 and edges 80 and 84 for valve spool 26. From a machining standpoint it is much easier to maintain critical tolerances for only one critical dimension per valve spool rather than having to provide a plurality of dimensions all critically spaced from a given flow controlling edge such as in the prior art single valve spool of FIG. 2. It is also noted from FIG. 3 that the springs positioning the two valve spools 24 and 26 can each be individually adjusted by the two threaded plugs 86 and 88. Thus each valve spool 24 and 26 can be individually centered or axially moved to a null position without disturbing the null position of the other spool. This is of course impossible in the prior art embodiment of FIG. 2 where both adjustment mechanisms 52 and 54 result in the movement of the spool 44.

Furthermore, adjustment of the two threaded plugs 86 and 88 may be utilized to adjust the null pressure (or point of initial opening of the valves) and the deadband of the valves. As noted above, each valve spool may be individually adjusted to its own null position. The compression of each lower spring causes equal compression on the upper spring, thus still maintaining a spring force balance on each valve spool. An upward adjustment of plug 86 and a downward adjustment of plug 88 causes valve spool edges 72 and 84 to move closer to the connection to flow return $P_T$ which reduces the null pressure. This also requires an increased stroke for both valve spools to reach pressure supply $P_S$ thus increasing the deadband. Opposite adjustment of the two plugs 86 an 88 will increase the null pressure since the spool edges 76 and 80 now been moved closer to their connection to pressure supply $P_S$. This also reduces deadband since less valve spool stroke is needed to cause flow connection to pressure supply $P_S$.

Experimental testing has further indicated that the load flow curve of the two spool embodiment of FIG. 3, that is flow output versus differential pressure generated by the load, is relatively flat or linear when compared with the load flow curve generated by the prior art single spool device. Thus significant advantages are obtained by utilizing two separate valve members, each controlling a single output of the boost stage valve in a two stage flow control device.

The flow control boost stage valve, due to its relatively large spool valves, amplifies the flow capabilities of the pilot valve and provides a differential flow output which is proportional to the pressure differential between signals $C_1$ and $C_2$. The boost stage flow output is particularly useful for driving loads such as a hydraulic cylinder or ram. Therefore a ram is shown as load 30 in FIG. 3.

A two stage pressure control utilizing the present invention is taught in FIGS. 5–9. Since many of the elements used in the two stage pressure control are similar to the elements of the two stage flow control of FIGS. 1–4, such similar elements are numbered consistently with the elements of the flow control but in the 100 series of numbers.

Figure 5:
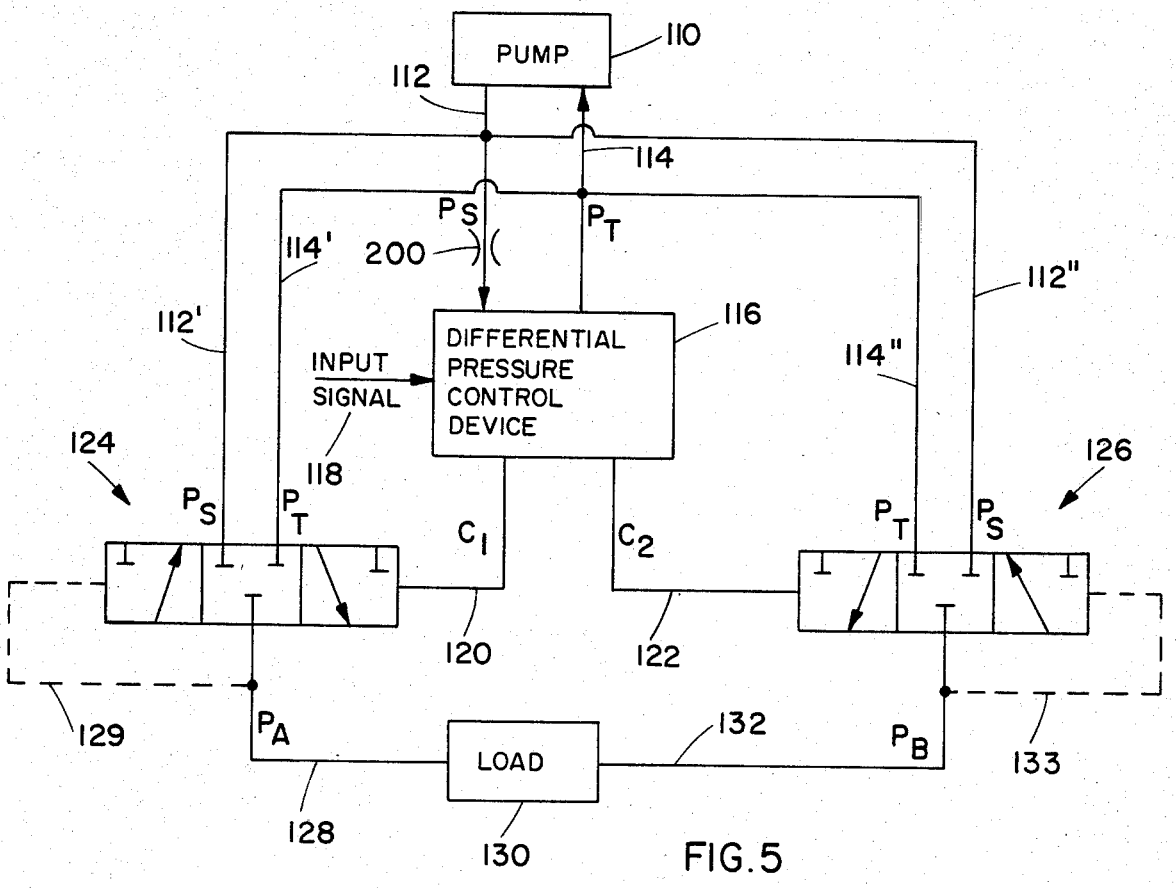
FIG. 5 is a schematic diagram of the two member boost stage valve as used in a pressure control.

As seen in the schematic of FIG. 5, the two stage pressure control valve system is also provided with fluid under pressure by a pump 110 to provide a pressure source $P_S$ connected by lines 112, 112' and 112" to a PCP 116 and first and second boost stage valves 124 and 126 respectively. Similarly a return flow $P_T$ is provided from these control elements by lines 114, 114' and 114". The PCP 116 has an input signal 118 which generates two pressure output signals $C_1$ and $C_2$ in lines 120 and 122. In the flow control device of FIG. 1, the control signal $C_1$ and $C_2$ are applied to both valves. However, in the pressure control device of FIG. 5, $C_1$ is only applied to the first boost stage valve 124 by line 120 and the second pressure signal $C_2$ is only applied to the second boost stage valve 126 by line 122.

The first boost stage valve 124 has an output $P_A$ connected by line 128 to load 130 while the second boost stage valve 126 has an output $P_B$ connected by line 132 to load 130. These two outputs are labeled $P_A$ and $P_B$ since they are pressure controlled rather than flow controlled as are the outputs $F_A$ and $F_B$ of the control device of FIG. 1. Feedback lines 129 and 133 are provided to connect the output lines 128 and 132 respectively with the first boost stage valve 124 and with the second boost stage valve of 126. Thus, it is noted that the force balancing on the boost stage valves in the pressure control device is generated by a feedback pressure bias rather than by spring balancing. Therefore an increase in pressure signal $C_1$ moves the first boost stage valve 124 to the left against the feedback pressure in line 129 and thus connects the source $P_S$ to the first boost stage controlled output $P_A$. A reduction in pressure $C_1$ would connect the first boost stage output $P_A$ to the flow return $P_T$. An increase or decrease in pressure in signal $C_2$ would have a similar modulating effect on the second boost stage valve 126 and its controlled output $P_B$.

Figure 6:
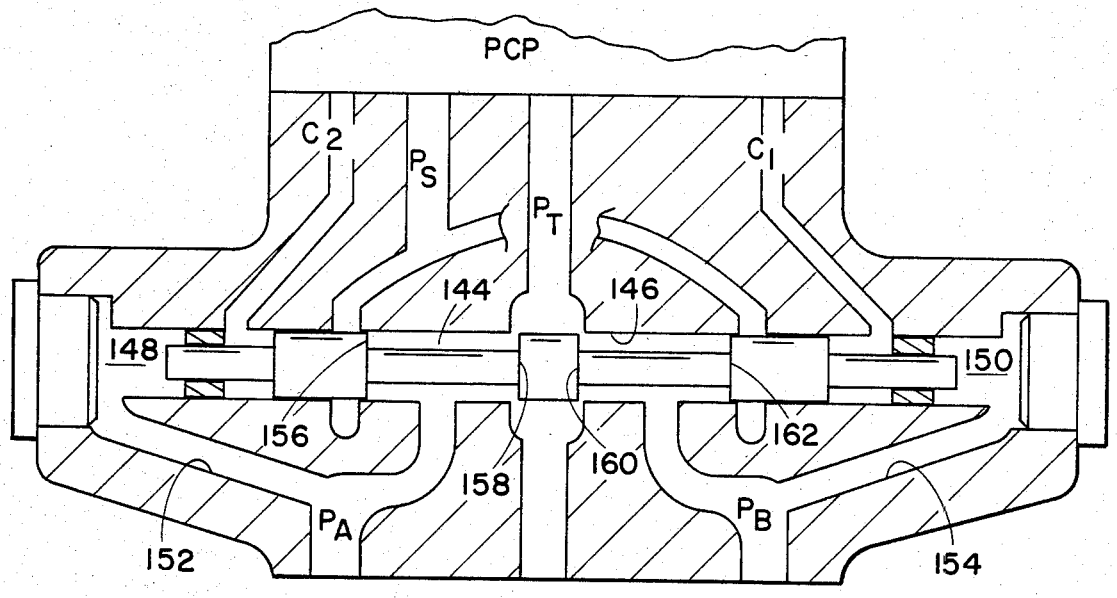
PRIOR ART FIG.6
FIG. 6 is a sectional view of a prior art single spool boost stage valve as used in a pressure control.

FIG. 6 teaches a prior art device utilizing a single valve spool 144 axially movable in a bore 146 to provide a four way valve control of output $P_A$ and $P_B$. The valve spool 144 is positioned by the pressure differential supplied by input signals $C_1$ and $C_2$ applied at opposite ends of the valve spool. Further positioning at the valve spool 144 are feedback pressures in feedback chambers 148 and 150 which communicate with the control pressure outputs $P_A$ and $P_B$ by lines 152 and 154 respectively. Similar to the single valve spool of the prior art flow control of FIG. 2, the single valve spool 144 in the pressure control also has four flow controlling edges 156, 158, 160 and 162 which are used to modulate flow to and from the boost stage outputs $P_A$ and $P_B$ as the axial positioning of the valve spool 144 is modulated by the control forces. Thus the same critical dimension problems generated by the prior art single spool 44 also occurs with the single spool 144. Furthermore, it is again noted that the two inputs $C_1$ and $C_2$ along with the two feedbacks are all applied to a single valve spool and thus all four critical edges must move together and in response to all outputs. Therefore there could be no separate control of the flow controlling control edges controlling the output $P_A$ relative to the control of the flow controlling edges of the output $P_B$. Furthermore, the single valve spool 144 must have at least three axially spaced lands and be relatively long thus increasing the mass of the valve spool 144.

Since feedback chambers 148 and 150 must be separate from the chambers for control signals $C_1$ and $C_2$, this requires outboard stubs on spool 144 and separate end bushings for the stubs. This increases friction on the valve spool during operation. Since the control pressures $C_1$ and $C_2$ may be higher than the feedback pressures, $P_A$ and $P_B$; the stubs must be integral with the spool 144 to prevent separation. This further increases machining difficulties since the bushings must be concentric with the spool 144.

Figure 7:
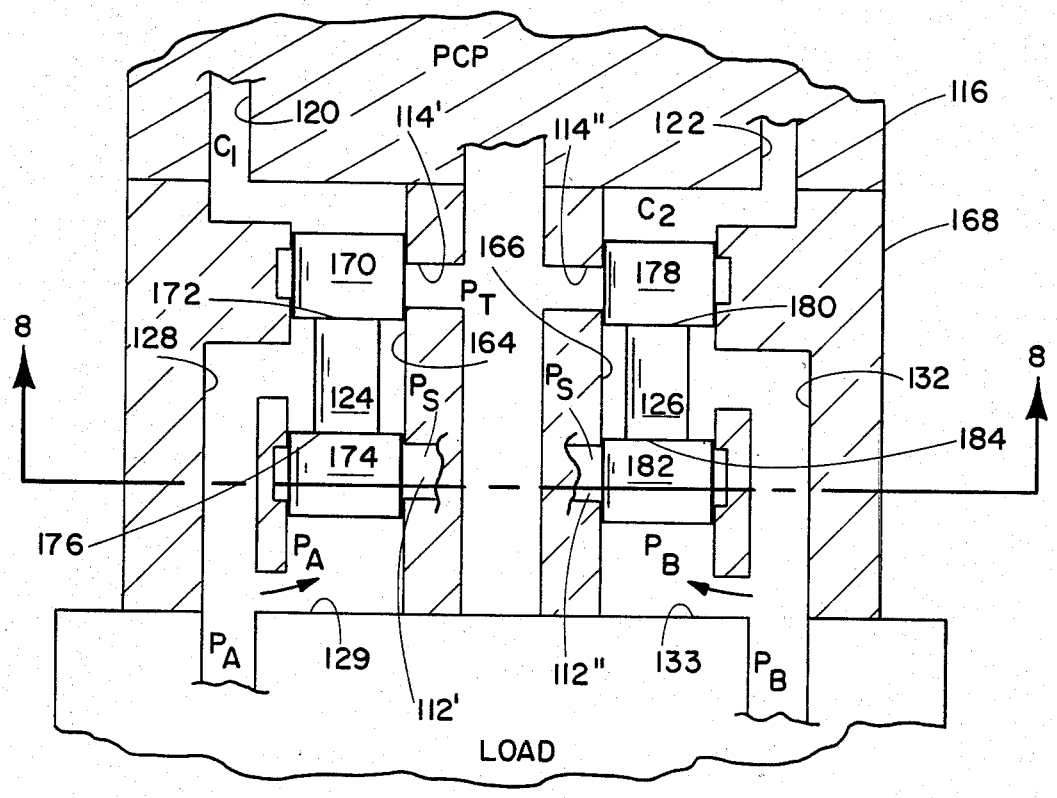
FIG. 7 is a cross sectional view of the two member boost stage valve of the present invention as used for a pressure control.
Figure 8:
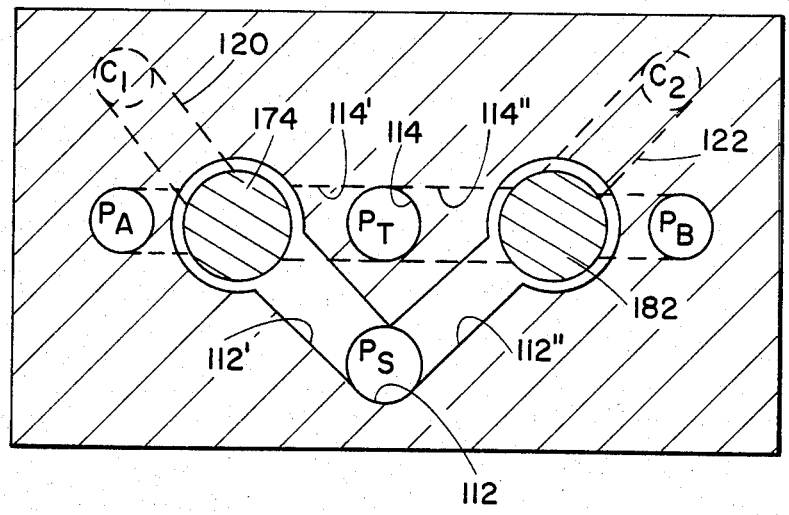
FIG. 8 is a cross sectional view taken along lines 8—8 of FIG. 7.

FIGS. 7 and 8 show sectional views of the improved pressure control boost stage valve wherein the two boost stage valve members 124 and 126 are utilized instead of a single valve spool. Similar to the construction of the flow valve of FIG. 3, the two valve members 124 and 126 consist of spool valves axially movable within short bore sections 164 and 166 formed within a compact boost stage valve housing 168. Preferably the valve bore sections are parallel and extend from a first end to a second end of the valve housing 168. The first valve spool 124 has a first land 170 with flow controlling edge 172 and a second land 174 with a flow controlling edge 176. The second valve spool 126 also has a first land 178 with a flow controlling edge 180 and a second land 182 with a flow controlling edge 184. The first pressure controlled boost stage output $P_A$ is centrally connected to the bore 164 between the first valve spool lands 170 and 174. The second pressure controlled boost stage output $P_B$ is connected by line 132 to the second bore 166 between the valve spool lands 178 and 182. Thus in many respects, the construction of the pressure control boost stage two spool valve of FIG. 7 is similar to the flow control boost stage valve of FIG. 3. A typical load for the pressure control output of the boost stage valve could be either another servo valve (including proportional valves) which would act as a third stage, or a hydraulic device requiring a differential pressure control input such as a hydraulic cylinder or ram.

In the pressure control boost stage valve of FIG. 7 the two valve spools 124 and 126 are modulated by a balance of pressures and do not utilize spring centering forces. As stated with the description of the schematic of FIG. 5, control signal $C_1$ is only applied to the first boost valve as seen by line 120 in upper left hand corner of FIG. 7. Control signal $C_2$ is applied to the upper end of the valve spool 126 by line 122. Thus only one valve is subjected to each control pressure signal $C_1$ and $C_2$. Balancing these control signals are the two feedback pressures from the boost stage outputs $P_A$ and $P_B$ as provided by lines 129 and 133 located at the lower end of the valve housing 168 and communicating the first output line 128 with the lower end of the valve bore 164 and boost stage output line 132 with the lower end of the bore 166. The balancing of the two respective feedback pressures against the input control signals $C_1$ and $C_2$ modulates the position of the two spool valves 124 and 126 respectively within the bores 164 and 166. When the boost stage valve is in the vertical plane, the hydraulic pressures acting on the valve spools swamp out any effects due to gravity. Of course, the boost valve may also be orientated in any other plane.

As seen from both FIGS. 7 and 8, the flow lines 112 and 114 for source $P_S$ and flow return $P_T$ are centrally located within the valve body and joined with both valve bores 164 and 166. The return flow line 114 is connected with the valve bores near the upper ends and adjacent the first valve lands of both valves by lines 114' and 114". The source $P_S$ is connected by lines 112' and 112" near the lower end of the bores and adjacent the lower valve lands 174 and 182.

Since full periphery valve lands are preferred to provide ease of machining the flow controlling edges, flow restrictions may be utilized in lines 120 and 122 conveying signals $C_1$ and $C_2$ to smooth pressure changes and thus stabilize valve operation.

As the valve spools 124 and 126 are modulated within the bores 164 and 166, the flow controlling edges 172 and 180 control the communication of the two boost stage outputs $P_A$ and $P_B$ with the flow return $P_T$. The flow controlling edges 176 and 184 control the communication between the pressure source $P_S$ and the two boost stage outputs $P_A$ and $P_B$. Again it is noted that only one critical dimension, that is the distance between the two flow controlling edges, is required for each valve spool thus greatly simplifying machining operations and not requiring that a plurality of edges be machined at specific distances relative to each other. Furthermore, it is noted that each valve spool only has two lands and is relatively short. Thus the mass of each valve spool is reduced allowing the valve spools to act more quickly to the forces applied thereon, and time of response is reduced. Most importantly. each valve spool only controls one boost stage output and that boost stage output is only subjected to a single control pressure counterbalanced by its own feedback. Therefore a plurality of control forces and a plurality of feedback forces are not applied to control an output not intended to be regulated thereby. It is noted that compared to the prior art example of FIG. 6, no outboard stubs are required to obtain feedback control, thus reducing spool friction during operation. This provides an improved load flow curve with little droop as proved by experimental testing. Furthermore, the elimination of the feedback stubs simplifies machining operations considerably. Machining of the two valve spools 124 and 126 of the present invention is further simplified since each spool controls only one output and thus the spool can adjust to provide the correct flow without having a critical valve overlap. In the prior art version of FIG. 6, the single spool controls all flow to both outputs, thus requiring that valve overlap for each output must be critically positioned relative to each other.

Figure 9:
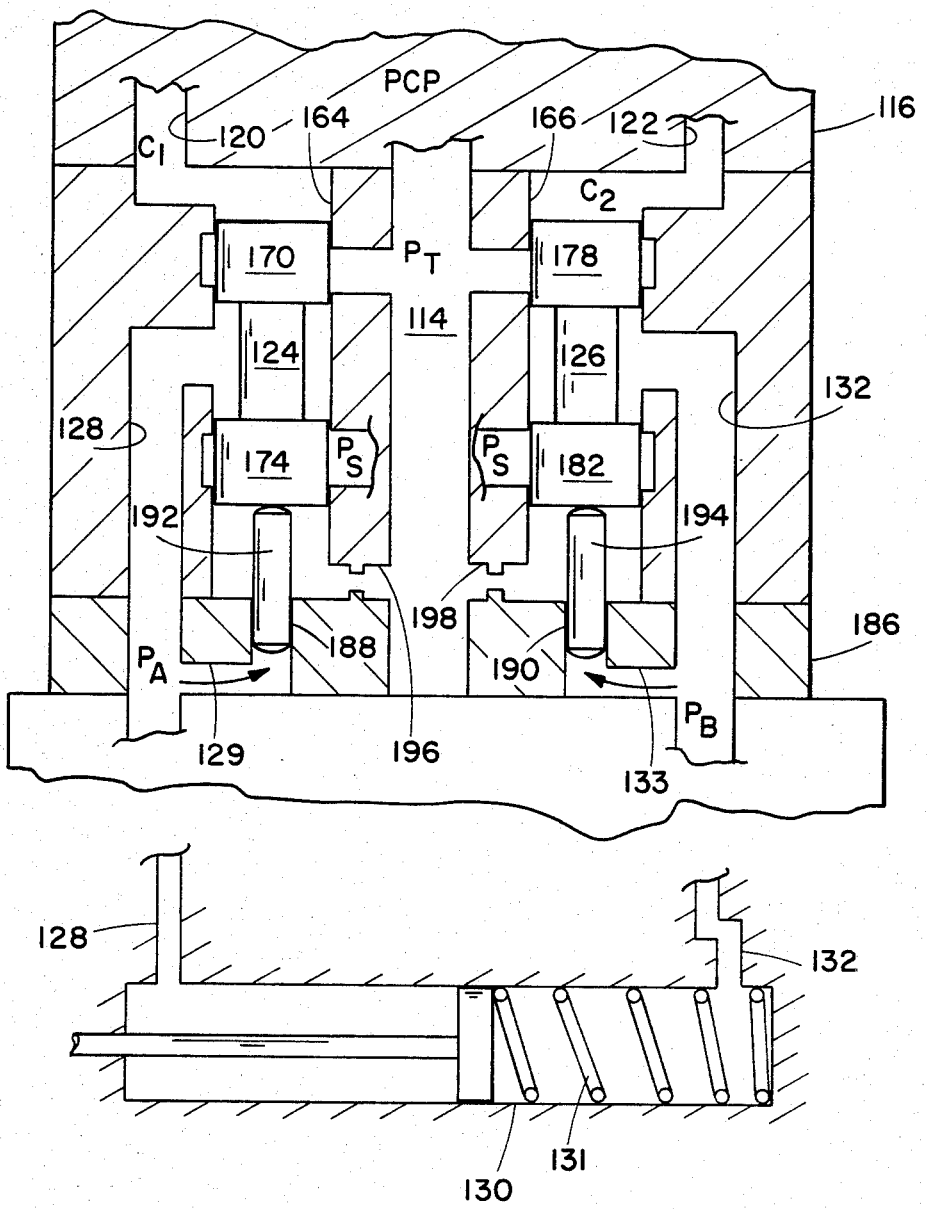
FIG. 9 is a cross sectional view of the modification of the two member boost stage valve for the pressure control of FIG. 7 wherein pressure amplification is provided.

FIG. 9 shows a modified version of the pressure control boost stage valve of FIG. 7 but where output pressure is boosted or amplified. Since the majority of the parts of the modification of FIG. 9 are identical to the parts of the pressure control FIG. 7, the same numbers are utilized to identify similar parts. In order to amplify the pressure output, it is necessary to multiply the feedback control pressure relative to the input control pressure. This is done by reducing the area of the valve spool to which the feedback pressure is applied relative to the area of the valve spool to which the control pressure is applied.

Therefore an additional valve plate 186 has been provided which now contains the feedback lines 129 and 133 which apply the boost stage output pressures $P_A$ and $P_B$ to the respective valve spools. The valve plate 186 has two reduced diameter vertical bores 188 and 190 axially aligned with the previously described valve bores 164 and 166. Two small diameter axially extending stubs 192 and 194 are received by the reduced bores 188 and 190 and bear against the lower ends of the two valve spools 124 and 126 respectively. While the stubs 192 and 194 may be made integral with the valve spools 124 and 126, from a machining standpoint it is preferred that the stubs are separate pieces. Each feedback pressure acts upon the reduced diameter stub and maintains contact between the stub and its respective valve spool. Since the bottom end of each bore 164 and 166 is not now connected to any of the control pressures, these valve bore chambers defined by the outer end of the lower lands 174 and 182 are connected to the flow return $P_T$ by restricted lines 196 and 198 respectively. This eliminates any pressure at the lower end of the bores 164 and 166 which would tend to separate the stubs 192 and 194 from the spools 124 and 126. Since the stubs 192 and 194 are separate from the valve spools 124 and 126, it is not required that the reduced bores 188 and 190 be concentric with the valve spools thus further reducing machining difficulties. Furthermore, it has been experimentally determined that the restrictions in such lines 196 and 198 increase the stability of operation of the boost stage valve and eliminate any need for restrictions in line 120 and 122 carrying signals $C_1$ and $C_2$.

The following example will explain the difference in operation between the nonamplified pressure control version of FIG. 7 and the amplified pressure control version of FIG. 9. For the FIG. 7 valve, if the source of the pressure $P_S$ is applied at 500 psi, the maximum pressure differential between the control signals $C_1$ and $C_2$ provided by the pilot stage will be in the neighborhood of 400 psi. In the nonamplified pressure control, since if the pressure supplied $P_S$ is at 500 psi, it is this pressure that is applied as the input to both boost stage valve members 124 and 126 and to the PCP 116. The maximum pressure differential between the two control signals $C_1$ and $C_2$ produced by the PCP 116 will be in the neighborhood of 400 psi. The pressure differential between the boost stage outputs $P_A$ and $P_B$ will be the same as the pressure differential between the inputs $C_1$ and $C_2$ and thus there is no pressure amplification. However, since the flow capacity of the boost stage valve is considerably greater than the flow capacity of the pilot stage PCP 116, there is an amplification of power transmitted since power is obtained by flow times pressure. Thus power amplification, with pressure control, is obtained.

In order to obtain the advantages of both power and pressure amplification in the modification of FIG. 9, the pressure of the source $P_S$ is increased to 2,000 psi. This 2,000 psi pressure which is applied to both boost stage valves 124 and 126 would damage the PCP 116. Therefore a restriction 200 as shown in FIG. 5 is introduced in line 112 between the pump 100 and the PCP 116. This restriction 200 protects the PCP against the excessively high pressure. In practice, such a restriction 200 may also be utilized in the flow control valve of FIG. 3 and the nonamplified pressure control valve of FIG. 7 in order to protect the PCP from excessive excursions in pressure from the source $P_S$. However, it is particularly necessary to use the restriction 200 in the pressure amplified version of the pressure control. In this pressure amplification version the restriction 200 also has further advantages which will be described later.

In the power amplification version of FIG. 9, it is noted that the diameters of the stubs 192 and 194 are small when compared to the diameters of the lands 170 and 178. In the example chosen, the valve lands 170 and 178 have a diameter 2.67 times the diameter of the stubs 192 and 194. Thus the cross sectional area of the valve lands is better than seven times the cross sectional area of the stubs. This results in the feedback pressures being seven times greater than the control input pressures $C_1$ or $C_2$ in order to achieve pressure balance across the valve spools 124 and 126. Thus the pressure controlled outputs $P_A$ and $P_B$ can have a pressure differential seven times the pressure differential of the control signals $C_1$ and $C_2$. This results in both flow and pressure amplification over the flow and pressure capabilities of the PCP to further increase the power amplification to the load.

Some loads may require that the pressure on one side of the load be greater than on the other side. In FIG. 9 a hydraulic ram 130 is shown where the effective area on the right side of the piston is piston area and the effective area on the left side of the piston is the area of the piston minus the area of the piston rod. For such application, stub 192 may be of smaller diameter than the diameter of stub 194 in order to provide greater pressure amplification for $P_A$ than for $P_B$. This would compensate for the two different effective areas of the ram 130 and could also compensate for a spring 131 if used. Such different pressure amplification may also be useful in other applications.

The PCP 116 is designed to provide a pressure differential between output signals $C_1$ and $C_2$ in proportion to the input signal 118. However since the PCP uses a flapper to balance flows between two nozzles, there is always a minimum pressure at $C_1$ and $C_2$ even though the pressure differential may be zero. This minimum pressure is proportional to the input pressure to the PCP. Therefore by utilizing the restriction 200 in the input line from the pressure source $P_S$ to the PCP, the input pressure to the PCP can be significantly reduced which reduces the minimum PCP output pressures at signals $C_1$ and $C_2$ even when the PCP is at null. For purposes of this example, where the pressure source is at 2,000 psi, it has been found advantageous to have the restriction 200 formed by an orifice of 0.028 inch diameter.

Since in the pressure amplification version of the pressure control boost stage of FIG. 9 the pressure of the outputs $P_A$ and $P_B$ is seven times the pressure of the input signals $C_1$ and $C_2$, it is deemed quite advantageous to keep the minimum pressure of the signals $C_1$ and $C_2$ low by utilizing the restriction 200 which in turn reduces the minimum output pressures of $P_A$ and $P_B$. Thus the restriction 200 has an advantage above and beyond mere protection of the PCP 116. While it is recognized that a reduced minimum pressure of the control signal $C_1$ and $C_2$ also limits the maximum pressure of the boost stage output, the total differential output of the boost stage is not significantly modified by the restriction 200 since both signals $C_1$ and $C_2$ and outputs $P_A$ and $P_B$ have been reduced by a proportional amount. Furthermore by utilizing the restriction 200 at the PCP 116, the boost stage output deadband, that is the range of input signal necessary to modulate the valve from a null position to produce an output signal, is eliminated.

It is thus seen by the above description of the preferred embodiments that the utilization of two boost stage valves, each separately controlling one of a pair of controlled outputs, produce significant advantages over the prior art structures. Although this invention has been illustrated and described with the particular embodiments illustrated, it will be apparent to those skilled in the art that various changes may be made therein without departing from the spirit of the invention as set forth in the appended claims.

I claim:

1. A boost stage valve for a two stage hydraulic flow control having a pilot stage transducer converting an input signal into a first signal and a second signal capable of generating a pressure differential, a source of fluid flow under pressure and a flow return at pressure lower than the pressure of said source, said boost stage valve comprising: first and second valve members independently movable within first and second valve chambers respectively, two pairs of spring centering means with each pair independently biasing sone of said valve members to a null position in its respective bore, a first boost stage controlled output in fluid communication with said first valve chamber, a second boost stage controlled output in fluid communciation with said second valve chamber, said first and second boost stage outputs being applied across a load, means for applying said pressure differential of said first and second signals to both of said valve members so as to move said valve members against the respective biasing forces of said spring centering means, and said source and said flow return communicating with both of said chambers whereby independent movement of said first and second valve members controls fluid communication between said first and second boost stage outputs respectively from said source and to said flow return.

2. The boost stage valve of claim 1 wherein separate adjustment means are provided for said valve spool spring centering means so as to separately adjust the null position of each of said valve spools within said bore sections.

3. The boost stage valve of claim 1 wherein said first and second valve members each comprise a valve spool having first and second axially spaced apart lands and said first and second valve chambers comprise bore sections receiving said valve spools for axial movement therein, said first and second outputs joining said first and second bore sections respectively at a position intermediate the lands of the respective valve spools.

4. The boost stage valve of claim 3 wherein said first and second bore sections are separate parallel bores located within a valve housing and the fluid communication between said source and said flow return are located within said valve housing and between said parallel bore sections.

5. The boost stage valve of claim 3 wherein said first signal communicates with one end of both bore sections and the second signal communicates with the opposite end of both said bore sections.

6. The boost stage valve of claim 3 wherein the source communicates with said first bore section adjacent said first spool land nearest the end communicating with second signal and communicates with said second bore section adjacent the second spool land nearest the end of said second bore section communicating with said first signal.

7. A boost stage valve for a two stage flow control having a first stage transducer converting an input signal into a first pressure signal $C_1$ and a second pressure signal $C_2$ which comprise a differential pressure output, a source of fluid flow under pressure $P_S$ and a flow return $P_T$ at a pressure lower than the pressure of said source $P_S$ said flow control boost stage valve comprising: a first valve spool having first and second axially spaced apart lands and being axially positionable within a first valve bore section, a second valve spool having first and second axially spaced apart lands and being axially positionable within a second valve bore section independent of the movement of said first valve spool, first and second spring centering means acting independently to center said first and second valve spools within their respective valve bore sections, first fluid communication means applying said flow return $P_T$ to said two valve bore sections adjacent said first land of said first valve spool and said second land of said second valve spool, second fluid communication means applying said source $P_S$ to said two valve bore sections adjacent said second land of said first valve spool and said first land of said second valve spool, two separate controlled outputs connected across a load and each output connected to a separate one of said valve bore sections intermediate the lands of said valve spools, third fluid connection means connecting said first pressure signal $C_1$ to said valve bore sections outboard of said first valve lands and fourth fluid connection means connecting the valve second pressure signal $C_1$ to said valve bore sections outboard of the second lands of said valve spools whereby a fluid pressure differential between signals $C_1$ and $C_2$ imparts axial movement to both valve spools connecting one of said outputs to source $P_s$ and the other of said outputs to flow return $P_T$.

8. The boost stage valve of claim 7 wherein said first and second spring centering means each comprise a pair of springs, one spring acting on each end of its respective valve spool, and wherein separate spring adjustment means are provided acting on one spring in each pair to provide adjustment of the null position of each valve spool within its respective valve bore section.

9. The boost stage valve of claim 7 wherein said valve bore sections are separate parallel valve bores within a valve housing having a first end and a second end, said bores extending from said first end to said second end of said valve housing.

10. The boost stage valve of claim 9 wherein said first and second fluid connection means include fluid conduits centrally located between said parallel valve bores in said valve housing to form a compact valve structure.

11. The boost stage valve of claim 9 wherein said spring adjustment mechanisms are located in each of said valve bores at one of said ends of said valve housing.

* * * * *